US005319562A

United States Patent [19]

Whitehouse

[11] Patent Number: 5,319,562

[45] Date of Patent: Jun. 7, 1994

[54] SYSTEM AND METHOD FOR PURCHASE AND APPLICATION OF POSTAGE USING PERSONAL COMPUTER

[76] Inventor: Harry T. Whitehouse, 70 Hayfield Rd., Portola Valley, Calif. 94028-7249

[21] Appl. No.: 748,823

[22] Filed: Aug. 22, 1991

[51] Int. Cl.[5] ..... G07B 17/00

[52] U.S. Cl. ..... 364/464.03; 364/464.02

[58] Field of Search ..... 364/464.02, 464.03

[56] References Cited

U.S. PATENT DOCUMENTS

| | | | |
|---|---|---|---|
| 3,983,366 | 9/1976 | Gunn | 235/454 X |
| 4,122,532 | 10/1978 | Dlugos et al. | 364/464.02 |
| 4,649,266 | 3/1987 | Eckert | 364/464.02 X |
| 4,725,718 | 2/1988 | Sansone et al. | 235/495 X |
| 4,797,830 | 1/1989 | Baggarly et al. | 364/464.03 |
| 4,813,912 | 3/1989 | Chickneas et al. | 364/464.02 |
| 4,821,195 | 4/1989 | Baer et al. | 364/464.02 |
| 4,864,506 | 9/1989 | Storace | 364/464.02 |
| 4,868,757 | 9/1989 | Gil | 364/464.03 |
| 5,072,397 | 12/1991 | Barns-Slavin et al. | 364/464.02 |

*Primary Examiner*—Edward R. Cosimano
*Attorney, Agent, or Firm*—Flehr, Hohbach, Test, Albritton & Herbert

[57] ABSTRACT

A distributed computer system enables end-users having personal computers to purchase postage from the post authority. End-user computers each include a modem for communicating with a computer at the postal authority, a secure non-volatile memory for storing postal usage and remaining postage information, a postage meter control program that includes a program for communicating with the postal authority to purchase postage and for updating the contents of the secure non-volatile memory. The end user computers preferably include a printer and a postage printing program for directing the printer to print addresses and postage on envelopes and labels. The postage printing program assigns a unique serial number to every printed envelope and label, where the unique serial number includes a meter identifier unique to that end user. As a result, every printed envelope and label contains a unique serial number. The postage printing program also directly controls the printer so as to prevent end users from printing more than one copy of any envelope or label with the same serial number. By capturing and storing the serial numbers on all mail pieces, and then periodically processing that information, the postal service can detect fraudulent duplication of envelopes or labels. The postage meter control program in each end user computer also allows the postal service to collect from the secure non-volatile memory audit information concerning postage purchased and postage applied to mail pieces by the end user's computer.

6 Claims, 12 Drawing Sheets

PLACE
FIRST
CLASS
POSTAGE
HERE

First-Class
Postage
Required
Post Office will
not deliver
without proper
postage.

First-Class
POSTNET
Personal
Automation
Discount
27 Cents
for 1st Ounce

Penalty for Private
Use to Avoid Payment
of Postage, $300

FIRST-CLASS
MAIL

U.S. POSTAGE PAID
PERMIT #99999
PALO ALTO, CA

Non Profit

U.S. Postage
PAID
Permit #99999
Palo Alto, CA

Internal Modem Card

SYSTEM AND METHOD FOR PURCHASE AND APPLICATION OF POSTAGE USING PERSONAL COMPUTER

BACKGROUND OF THE INVENTION

Field of the Invention

This invention relates to the preparation and subsequent processing of mail in the United States and its territories. More specifically, the invention focuses on means to apply postage to envelopes, mailing labels, and flyers using an ordinary personal computer and printer (laser, inkjet or matrix).

The invention also provides a convenient method to purchase U.S. postage via phone/modem, the ability to maintain a computerized account of postage expenditures, and provisions for remote electronic audit functions by the U.S.PS Inspection Service.

Importantly, the invention is integrated with an existing mail management software product called Envelope Manager which has the ability to obtain ZIP+4 information using conventional phone lines, track and maintain the age/currency of stored ZIP+4 information, print a POSTNET bar code, print a FIM (Facing Identification Mark), and compute an appropriate discount for automation-readable mail.

Automation Goals of the United States Postal Service

Since the early 1980's, the U.S. Postal Service has focused a vast majority of its R&D efforts on the automated handling of mail. Processing some 160 billion pieces of mail per year (rising to an estimated 200 billion pieces/year by 1995), the U.S.PS mail flow is greater than that handled by the next five largest national postal systems combined. One of the key elements in the automation program is the machine sortation of mail pieces.

To accomplish sortation, the LAQPS has embarked upon a massive effort to bar code all mail by 1995. The bar code employed by the U.S.PS mail processing equipment is knowh as POSTNET, and is comprised of a series of short and long bars which encode a ZIP+4 for a given address. This bar code sequence can be presently seen on certain types of mail pieces today—particularly business reply and courtesy reply (payment) envelopes.

Another related bar code option will be supported by the U.S.PS in late 1991. It is called the Delivery Point Bar Code or Advanced Bar Code ("ABC"). The Delivery Point bar code begins with the bar code representation of the ZIP+4 and adds the bar code equivalent of the last two numbers of the street address. This leads to even finer sorting resolution.

The POSTNET bar code is a critical element in the multiple sorting steps that occur between U.S.PS acceptance of a mail piece and the delivery. In fact, bar-codes are so important that the U.S.PS applies them to a great fraction of incoming letters using some very complex and expensive equipment.

To understand where and how this bar coding is accomplished—as well as the value of prebar coded mail—we will refer to FIG. 1. This figure shows the key sortation steps undertaken at the "originating" U.S.PS site. All mail collected in a given geographic area (say Washington, D.C., for example) is amassed nightly at a General Mail Facility or "GMF". This GMF is referred to as the "originating site".

The mission of the GMF is to sort the mail flow down to the first three digits of the ZIP code so it may be loaded that evening on trucks or planes destined for key distribution points around the country. The GMF also looks up ZIP+4's for and applies POSTNET bar codes to as much mail as practical. This complex effort is undertaken so that subsequent sortation steps at the GMF and the destination offices can be done automatically by low-cost bar code sorters.

The very first step in the GMF handling/sorting occurs at the Facer-Canceller machine (c.f; FIG. 1). This machine mechanically orients all mail pieces so the address and postage are facing in a uniform direction. It will also place a cancellation mark on the mail piece if it carries a glued stamp.

Importantly, if the mail piece contains a Facing Identification Mark of pattern "A" or "C" (c.f., (FIG. 2*a*), the equipment will detect this condition and infer that the mail has been prebar coded (c.f., FIG. 2*b*). The prebar coded mail is routed directly to low-cost bar code sorters at the end of the GMF process (bypassing some extremely complex and time-consuming steps which we will discuss momentarily) and loaded on the appropriate truck or plane.

Mail which has no POSTNET bar code enters one or more of the sorting environments shown in FIG. 1. If the mail piece is of odd size/shape, it proceeds to the manual sorting bays. Manual sorting is by far the most expensive operation at the U.S.PS as it is highly labor-intensive.

If the mail piece is between postcard and COMM-14 size and has a typed or printed address, it is directed to the Multi-line OCR machine. The OCR processes 10 envelopes/second, reading the address optically, looking up the ZIP+4 on a nearby main-frame computer, and "spraying" the POSTNET bar code on the mail piece using ink jet technology. Again, the importance of applying the bar code at the originating site is that it is used numerous times both at the originating GMF and when it arrives at the destination U.S.PS offices on the following day. Each sortation is run to a finer level—eventually sorting mail in delivery order for a given street in AnyTown, USA.

If the mail piece is of conventional size but handwritten (or otherwise unreadable) by the OCR, it enters the MPLSM stream. Using these semi-automated sorting machines, operators read significant components in the address fields and enter command codes into a small keyboard to route the mail piece to the appropriate sortation bins.

The relative value of prebar coded mail is underscored by the following U.S.PS cost factors:

| | |
|---|---|
| Manual Sortation | $40/1000 pieces |
| Sortation by POSTNET bar code | $4/1000 pieces |

As some 80% of the annual $40 billion dollar U.S.PS budget is allocated to employee payroll, the POSTNET bar code can be readily seen as a critical factor in controlling U.S. postage costs. The U.S.PS has a staff roster of over 700,000 men and women, with the great majority involved in mail processing and carrier delivery. A typical carrier spends up to 50% of his or her work day sorting mail by hand before walking or driving the actual delivery route. Bar coding is expected to reduce carrier sorting time by 25% to 50%, as the Delivery Point barcoded mail can be sorted by machine to the sequence in which the carrier travels his/her route.

Beginning in February, 1991, financial incentives became available to Postal customers who prebar code their outgoing mail. This is essentially an effort to reduce the expensive and relatively slow Optical Character Reading (OCR) step undertaken by the U.S.PS at major mail processing centers. The U.S.PS estimates that a savings of 60 to 80 million dollars per year will be achieved for each 1 percent of the mail volume which is pre-barcoded. These savings will be directly reflected in future postage prices, as the U.S.PS has operated since 1973 as a quasi-government agency with full responsibility for its own budget.

The savings attributable to automation are so dramatic that the U.S.PS now offers a user discount of up to 5.7 cents for each First Class pre-barcoded mail piece effective with the February, 1991 rate increase. The 5.7 cent discount applies to 500 pieces of mail or more. A 5.3 discount applies to quantities of 250 automation-readable envelopes and postcards. Under consideration for future implementation is a 2 cent "personal automation" discount for a single, automation readable letter. This personal automation rate was recommended by the U.S. Postal Rate Commission in January, 1991 and implementation is now expected in November or December of 1991 (coincident with the introduction of the 30 cent First Class rate).

U.S.PS Concerns Regarding Discounts

While the U.S.PS is strongly committed to automation and providing automation incentives, the organization has a great concern about confusing the mailing public with a spectrum of discount options. A key reason for the delayed implementation of the 2 cent personal automation rate is the concern that small mailers will apply 27 cents in postage when, in fact, the mail piece does not actually qualify for the automation discount rate. The same concern carries over to higher volume mailers, although it is not as deeply felt since most high volume mailers have the resources and time to master the nuances of the postal rate structure. U.S.PSThe requirements for an automation discount are:

Recently-validated ZIP+4 ("CASS" or Coding Accuracy Support System Certified)

POSTNET bar code representation of ZIP+4

Facing Identification Mark (FIM)

The POSTNET bar code and FIM are depicted in FIG. 2.

The printing of the POSTNET bar code and FIM via PC printer is quite straightforward. A number of PC and mini-computer software products are currently available for this purpose. The Envelope Manager software which is included in support of this application contains these printing capabilities for a wide spectrum of laser and matrix printers which are used with computers.

Obtaining a valid ZIP+4. for an address is much more difficult as the national address data base consumes some 4 gigabytes of computer storage. In printed form, the national data base of acdresses would large office room. A prior patent filing by this application (Filing Ser. No. 07/605,649; System and Method for Accessing Remotely Located ZIP+4 Zipcode Database, pending) advances a concept called Dial-A-ZIP. Here a standard phone and PC modem are used to access a ZIP+4 from a remote PC or mainframe which is equipped with a copy of the U.S.PS certified national ZIP+4 data base. A computer equipped in this way is referred to as a ZIP-Station. A single address query can be accomplished in 15 seconds. Up to 100 addresses can be submitted in a single phone call, with an average response time of 1.5 seconds per address. The overall process is similar to a credit-card verification and can be demonstrated by loading and using the accompanying Envelope Manager software.

The validated ZIP+4 is stored on the local PC along with the date of lookup. In this way, the computer can monitor the "age" of the ZIP+4. The U.S.PS requires that all automation-readable mail have a ZIP+4 which has been "CASS" (U.S.PS Coding Accuracy Support System) verified within the six months prior to the date the mail piece was sent.

The combination of a software printing system such as Envelope Manager and the Dial-A-ZIP technology can be used to address the great majority of the U.S.PS concerns regarding discount confusion. The Envelope Manager software contains a printing option which can place a number of "postage insignia" in the upper right hand corner of the mail piece. FIG. 3 illustrates some of the printing options in the current production version of Envelope Manager:

Of particular note is FIG. 3*c*, the Personal Automation Rate insignia. If the Envelope Manager user chooses this formatting option, this box will print in the upper right hand corner of the mail piece if and only if the mail piece also prints a valid ZIP+4 POSTNET bar code and FIM.

If the address being printed does not have a valid ZIP+4, or if the ZIP+4 has not been verified through a "CASS" certified source in the last six months, the insignia will revert to that shown in FIG. 3*a*. In this way, the software provides a means to automatically and clearly mark each mail piece as to whether it qualifies for a postal automation discount.

SUMMARY OF THE INVENTION

A data management, printing and data communications architecture is offered which brings together a number of common and relatively low-cost computer hardware elements in such a way as to provide automated postage metering for envelopes, labels and/or flyers. The metering will automatically incorporate any zonal price premiums or automation discounts. The configuration also provides a means to periodically purchase postage via telecommunications, and provides means for the U.S.PS to audit each individual meter by telecommunications.

FIG. illustrates a variety of postage markings printed by the current Envelope Manager software package.

Figure 4:
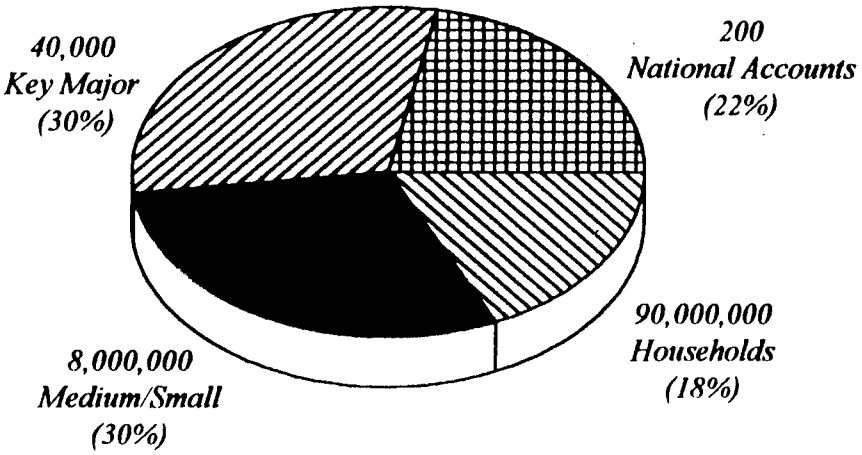

FIG. 4 illustrates mail volume demographics.

Figure 5:
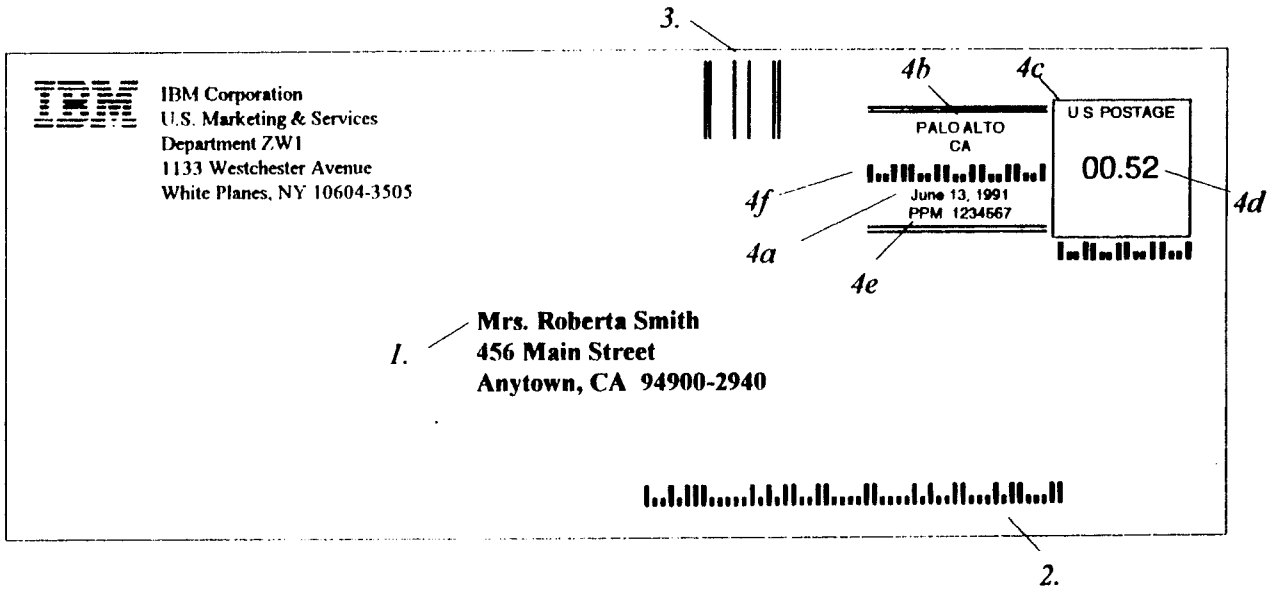

FIG. 5 illustrates a typical envelope laser printed from blank stock using this invention.

Figure 6:
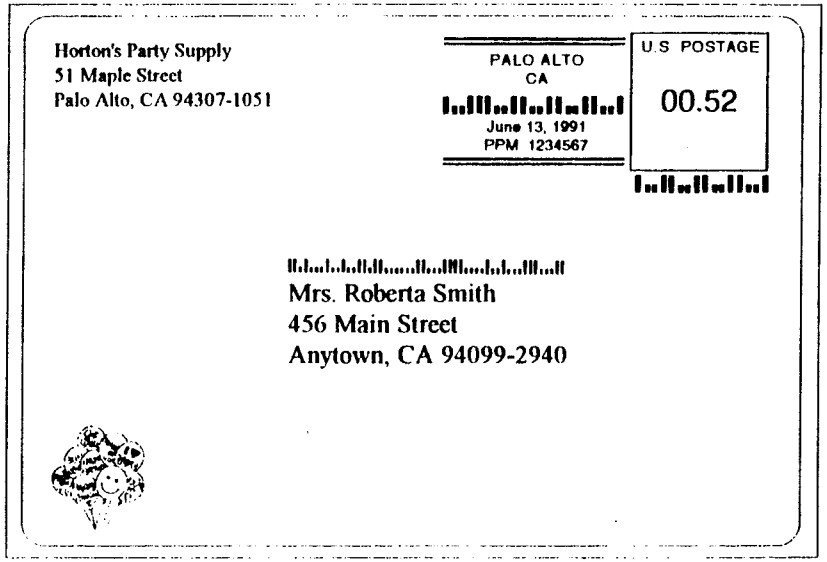

FIG. 6 illustrates an printed 4"×6" peel off label that could be applied to a flat or parcel.

Figure 7:
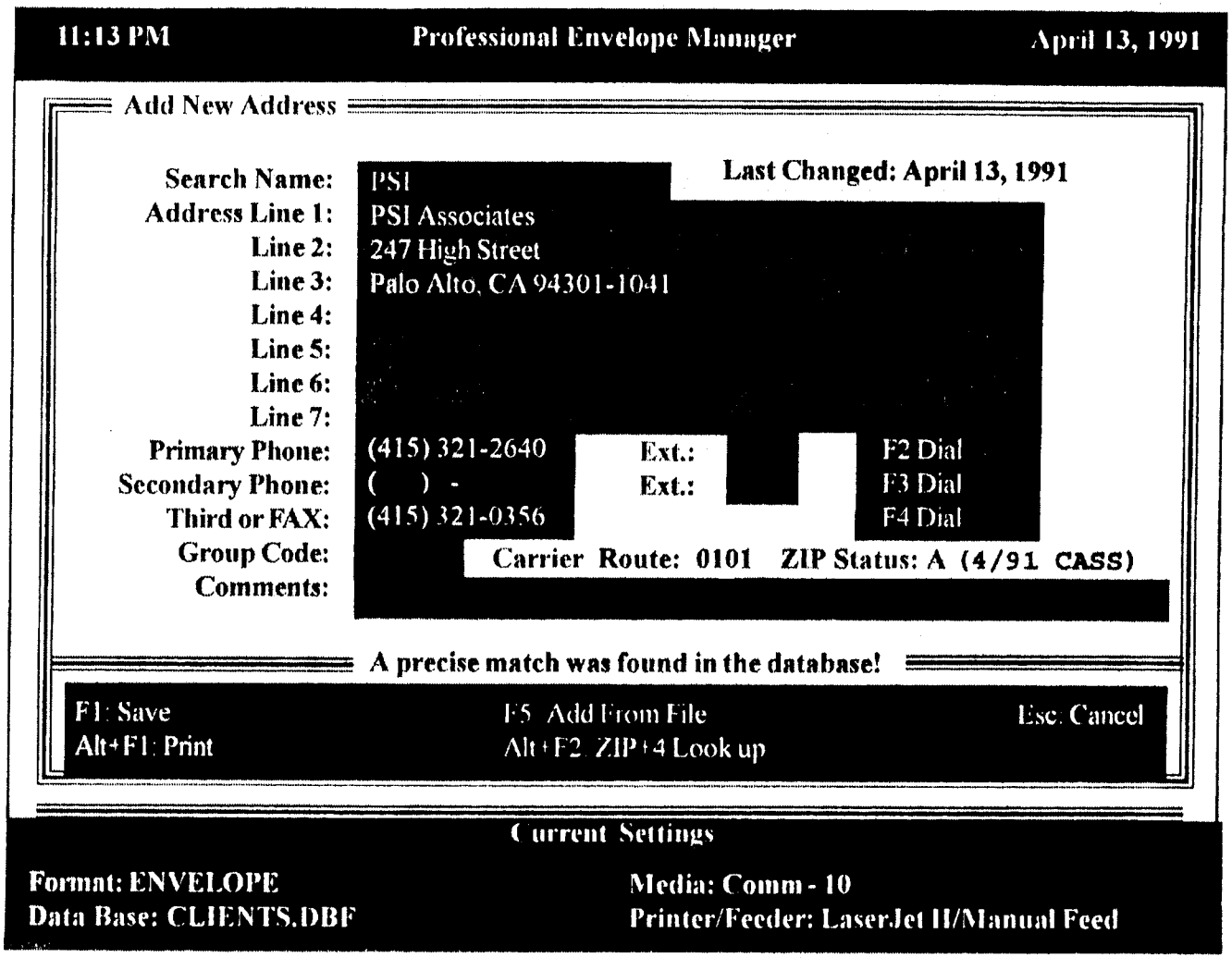

FIG. 7 illustrates a typical address entry/modify screen with the Dial-A-ZIP ZIP+4 look up feature.

Figure 8:
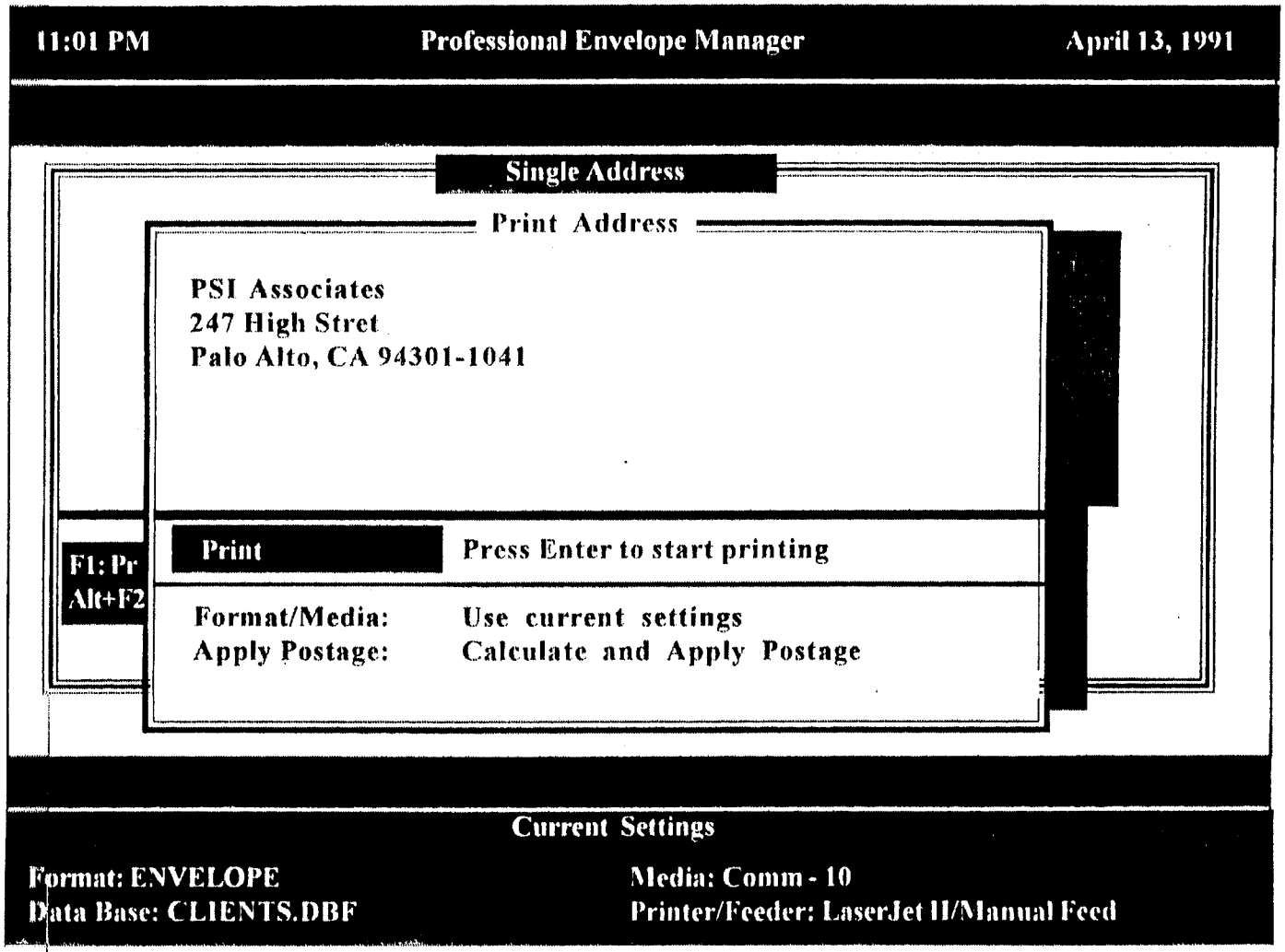

FIG. 8 shows a typical print request screen which shows a print-time "Apply Postage" option.

Figure 9:
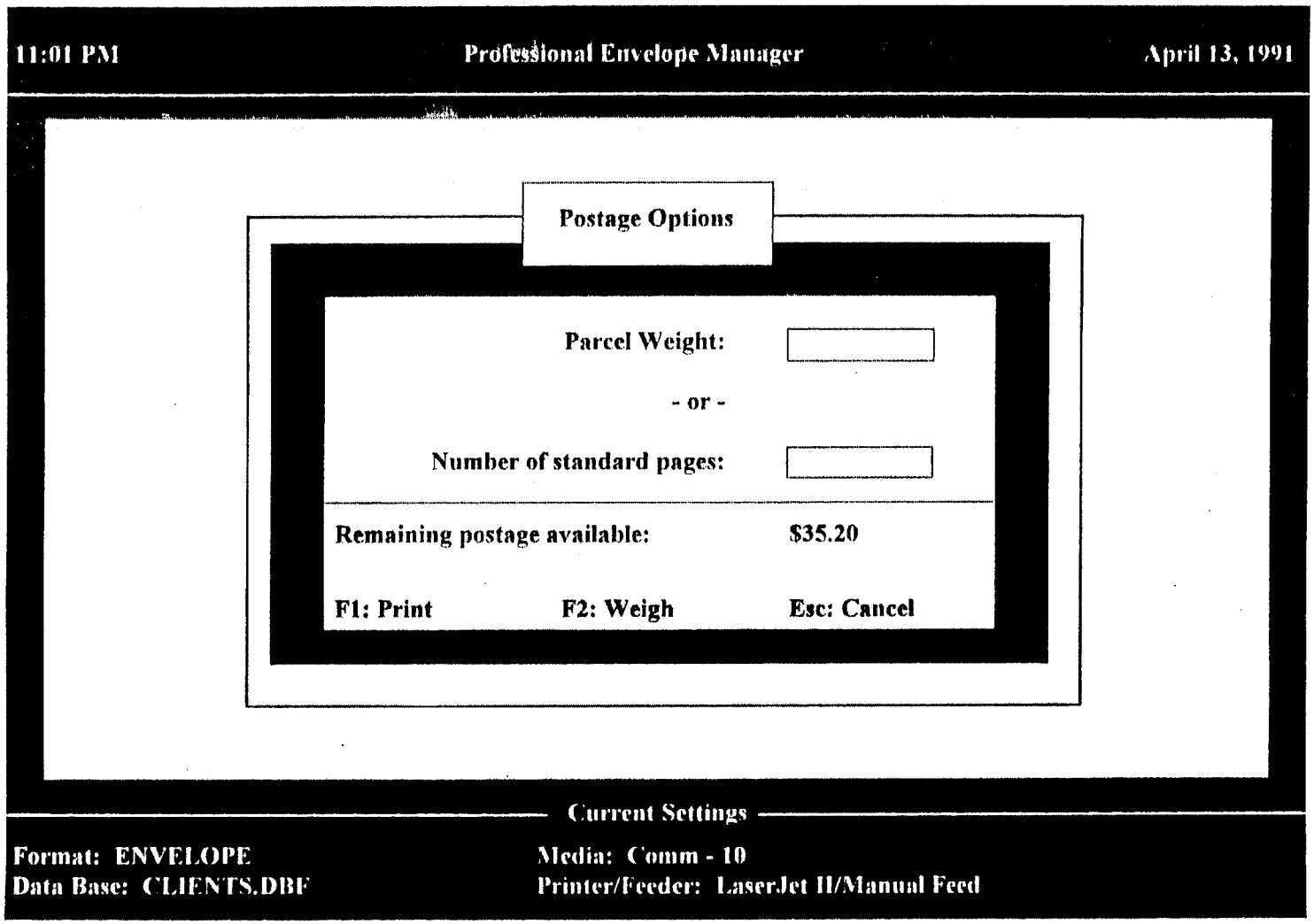

FIG. 9 illustrates a typical detail screen which appears when the Postage Option is selected.

Figure 10:
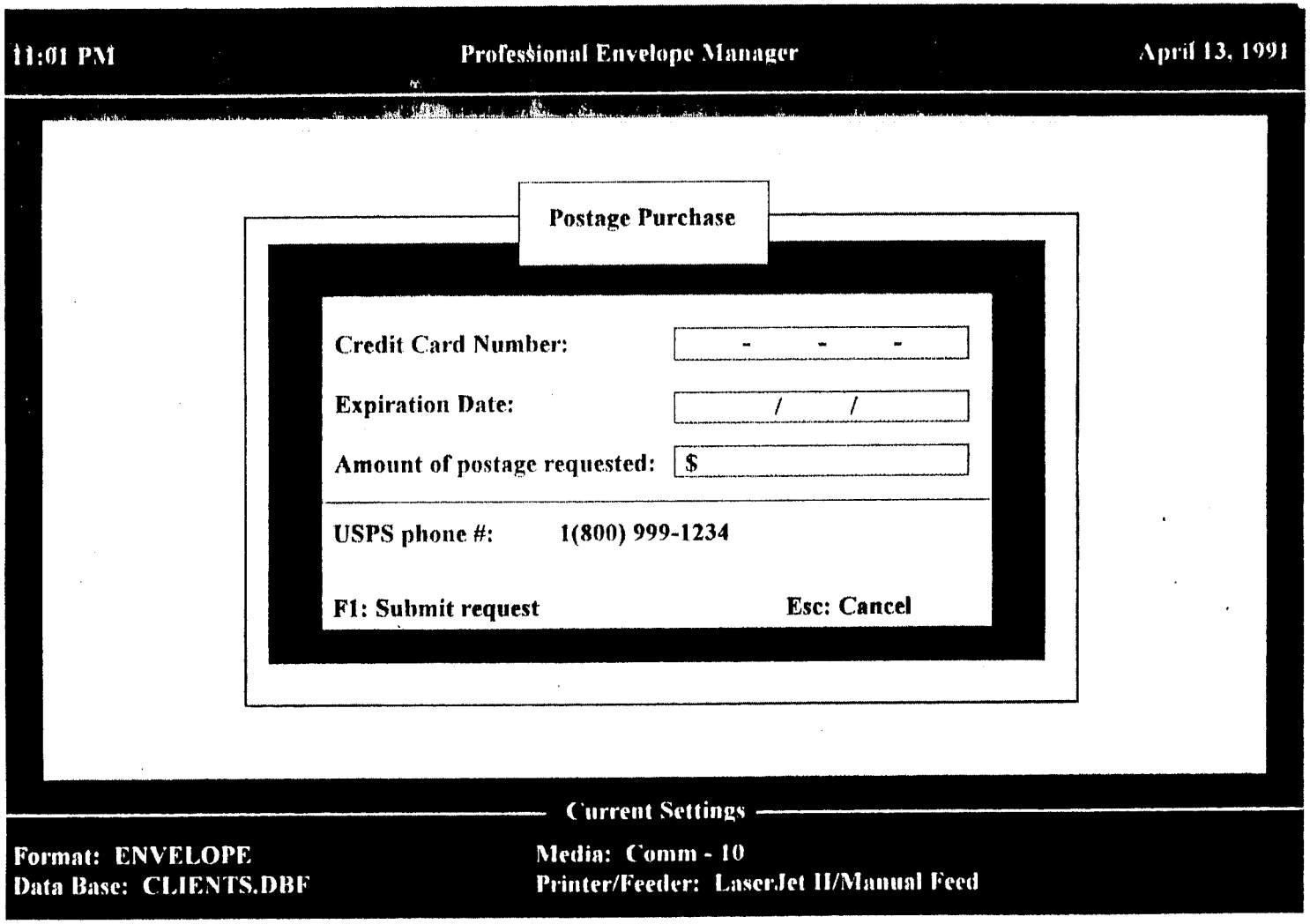

FIG. 10 illustrates a typical program screen to purchase additional postage via telecommunications.

Figure 11:
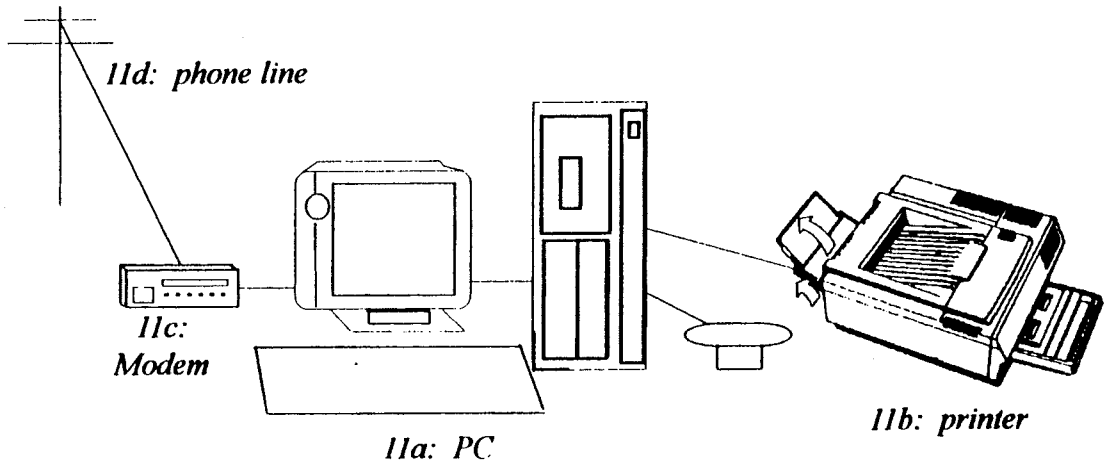

FIG. 11 illustrates a typical personal computer, printer, modem, standard phone line, and an optional weighing device.

Figure 12:
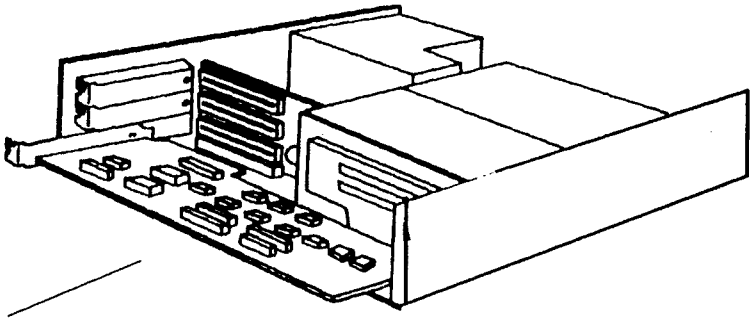

FIG. 12 illustrates a typical internal modem board for a personal computer.

DESCRIPTION OF THE PREFERRED EMBODIMENT

Application of Postage Via PC Printers

The technique discussed in the prior section assists in determining proper postage, but still depends upon a person to apply a correct stamp denomination or postage meter mark as a final step. This invention seeks to eliminate this final source of potential error by utilizing a personal computer/printer combination as a "personal postage meter." The invention also utilizes the PC as an automated means (via modem and conventional phone lines) to purchase additional postage as required. The tafter feature offers tremendous cost and time savings to both the mailing public and the U.S.PS.

Figure 2:
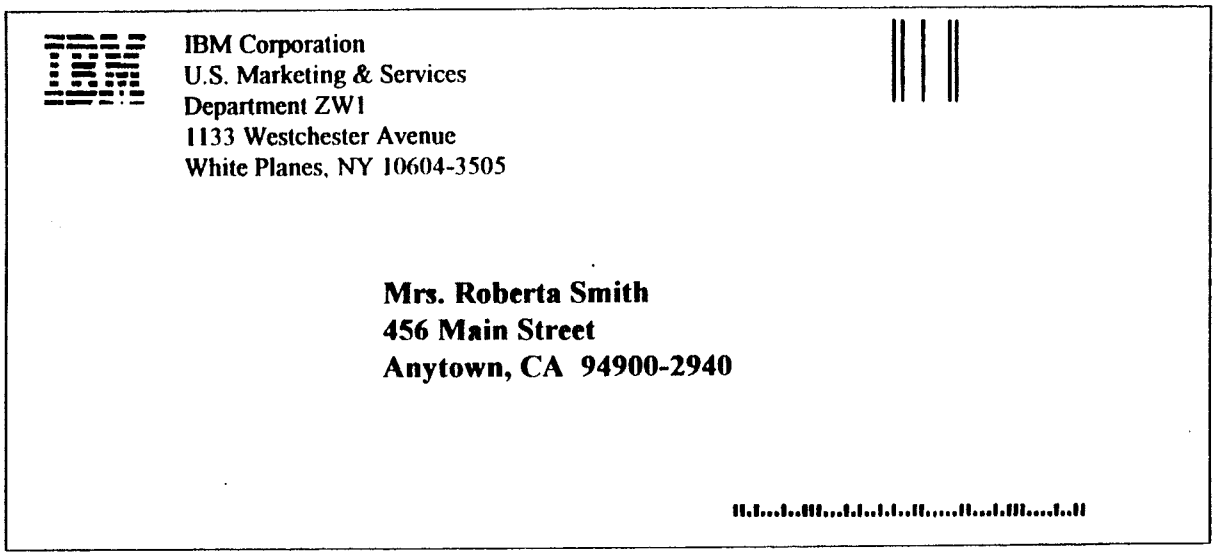
FIG. 2 illustrates an envelope with the postal automation FIM and POSTNET bar code markings.
Figures 3A, 3B, 3C, 3D, 3E, 3F:
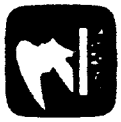

As noted previously, the Envelope Manager software product included with this application already provides means to "apply" certain types of postage to envelopes, labels and flyers. In addition to those illustrations in FIG. 2, the software will produce either Bulk or Business Reply Mail pieces on demand using a PC laser printer. In these cases, a unique WQPS permit number and city of issue is printed on each mail piece for accounting purposes.

This invention extends the existing postage application capabilities of Envelope Manager to the more conventional mail pieces. The invention features:

Means to apply a postage mark via desktop laser, inkjet or matrix printing technology.

Means to compute and print the appropriate amount of postage integral to the "mark" as a function of:
- Mail Piece Weight
- Automation Status (automation readable)
- Mail Classification (first, second class, parcel post)
- Destination Means to apply an optional POSTNET or UPC bar code representation of the postage amount.

Means to encode "meter identification" in both text and bar coded formats for automated accounting at Postal mail handling sites.

Means to assign and print a unique serial number for each mail piece in both text and bar coded formats to further enhance fiscal controls.

Means to print the date of postage application and city/-state of issue.

Means to purchase additional postage via PC modem and conventional phone lines, using either credit card or established account information to effect the purchase.

Multiple security means to prevent users from tampering with the amount of unused postage.

Means to allow U PS Inspection Service personnel to perform remote audits via phone/modem.

Meeting Customer Service Goals of the U.S.PS

While the U.S. Postal Service processes the overwhelming share of the mail and packages in the United States, it is under continuing pressure from competitors in the private-sector and some members of Congress. Competition has ranged from premium delivery services offered by Federal Express, Emery Air Freight, and United Parcel Service Blue Label, to regional delivery firms which specialize in the delivery of catalogs and third class advertisements. All of these competitors are viewed as serious threats by Postal management.

Elements of the Congress continue to propose the privatization of the mail service, or broadened competitive rules which permit more aggressive participation by private firms. The U.S.PS maintains that the current quasi-monopolistic posture of U.S. mail service is a requirement for uniform service throughout the nation and its territories.

The combined pressures of market competition and Congressional input have forced the U.S.PS to adopt a more market-oriented approach. In the words of Postmaster General Anthony Frank, "We have a monopoly, we need a monopoly, and we can't act like a monopoly."

Complaints about long lines and waits to buy postage continue to haunt the Postal Service. Postmaster General Frank, testifying to a House Subcommittee on Government Information on Jun. 13, 1991, indicated that he has set a goal of making customers wait no more than five minutes to buy stamps. Some 7,000,000 people visit the nation's 40,000 post offices each day and existing Postal Union contracts make it difficult to provide adequate counter staff to expeditiously service these customers.

The invention described in this application speaks not only to the automation goals of the U.S. PS, but squarely solves a major customer service issue. There are tens of millions of personal computers operating in the United States. If consumers could purchase and apply postage with their existing PC investment rather than physically travel to the post office, the number of retail counter transactions could be reduced dramatically. Further, postage could be purchased by phone 24 hours a day and 365 days per year with this invention. The net result will be a tremendous increase in customer service and satisfaction.

Comparing Existing Postage Application Technology with This Invention

Most low and medium volume mail generators apply postage manually (stamps) or with mechanical postage meters made by firms such as Pitney Bowes or Friden. The two latter firms benefit from a quasi-monopolistic arrangement with the UQPS, and their postage meters may only be rented.

Meters are periodically replenished with a dollar value of postage by physically carrying the unit to a nearby Post Office. The Postal customer pays a lump-sum amount (say $300) to the Postmaster and the clerk mechanically adjusts the postage meter with specialized tools. The meter is then resealed with a wire and embossed lead lock (analogous to a wax seal in early correspondence). The actual process can take up to 15 minutes and typically involves an inconvenience to the customer, the clerk, and all of the other Postal patrons waiting in line.

In the past few years, some of the larger Pitney Bowes postage machines have offered an option to replenish the meter via a phone line and dedicated communications hardware. The drawback here is that these machines are relatively uncommon (due to their cost) and require dedicated telecommunications equipment which can be used only for this purpose. These new machines also pose a problem for U.S.PS audit processes and fraud prevention. Currently, VAPS Inspectors must make on-site visits to firms which purchase postage via phone, adding considerably to U.S.PS operational costs. The invention described in this application uses the power of the remote personal computer in a way such that the U.S.PS audit may be accomplished by phone.

Postal meters are also limited in that they are essentially "ignorant" of the destination of the mail piece. The meter operator must examine certain mail pieces to ascertain the delivery "zone" (i.e., in parcel post mailings), and then apply the postage based on a chart of weight and zones. The invention described here prints the postage concurrently with the address and ZIP+4, so the program can automatically determine the zonal destination (the location of the sender is established in the supervisory setup of the program).

Another limitation of the postage meter machine is its inability to detect mail which qualifies for discounted postage rates (e.g., pre-barcoded mail). The invention described here, which is integrated with the Envelope Manager software, will concurrently determine the amount of the qualifying postage discount.

The only other variable in the computation of postage is the weight of the mail piece. In small volume environments, weighing is undertaken as a separate step, generally after the package is completely assembled. Postage is subsequently affixed by hand (stamps) or via a small postage meter after the weighing process.

In one embodiment, the invention described here will require the operator's knowledge of the mail piece weight prior to creating the envelope or label. This modification of work flow is not overwhelming, and computational aides are available to assist (for instance, the user is given the opportunity to indicate the number of pages in the document to be mailed and the computer estimates the net weight). It is also important to realize that a great fraction of first class mail is under one ounce and that actual weighing is rarely undertaken in practice.

In large mail room environments, dedicated electromechanical postage meters are available which both weigh and post each mail piece. Once again, the cost of these advanced units is several thousand dollars and not within the reach of the large majority of small business and home office environments. Nor are these units able to determine where each mail piece is going as the meters do not have a way to sense the actual address. This makes their utility limited in circumstances where delivery zones are important (e.g., parcel post).

Another embodiment of this invention includes a low cost scale (such as the OH CT600 scale with Ohaus meter #77172-00 R5232 interface) or "load cell" connected to the personal computer via a serial or "COM:" port. These scales or load cells are commonly used in computerized data acquisition systems. The devices have advantages over ordinary scales as they require no "read-out" device (the display function is provided by the personal computer) and often receive their electrical power from the connection to the personal computer. The net result is that adding an optional scale to the postage metering device involves only a modest cost.

Another recognized shortcoming of conventional mechanical postage meters is their print quality. There is little incentive for users to maintain sufficient ink to produce a clear, readable mark. A substantial fraction of metered mail will show evidence of a meter mark, but the actual amount of postage placed is indecipherable. The invention described here prints the postage mark using the same printing mechanism as that used for the main address and other printed elements of the mail piece (e.g. logos). Thus, the end user is much more likely to change laser toner cartridges or printer ribbons before print quality deteriorates significantly.

Postal Market Segment Addressed by This Invention

The invention described in this application essentially replaces the conventional postage meter with a combination of specialized (but low-cost) software and standard personal computer hardware (PC, printer, and modem). This combination of software and common hardware can be used to compute proper postage, account for zonal variations in postage, determine if automation discounts can be taken, apply the postage, maintain a running log of how and where postage was used, and replenish/purchase additional postage via modem.

This approach encourages postal automation through the proper and controlled use of U.S.PS discounts, reduces U.S.PS point-of-sale costs by automating the purchase of postage, and reduces the frustration level of postal customers trying to purchase postage. It is an ideal approach for home office and small business mailers.

The importance of the smaller mailer in overall U.S.PS demographics is shown in FIG. 4. This chart presents data gathered by the U.S.PS showing the breakdown of mail volume by source.

Note that 200 so-called key national accounts represent nearly ¼ of the 160 billion pieces of mail processed annually. Key national accounts include several Federal Agencies, Sears, the Armed Forces and the U.S.PS itself.

The next category, key major accounts, is comprised of 40,000 large mass mailers who have a reasonable automation posture to support ZIP+4 barcoding. Included here are major banks, department store chains, etc.

The third category accounts for 30% of the mail volume, but is distributed over 8,000,000 separate entities (small and medium businesses). Finally, the remaining 18% of the mail volume is generated by household mailers.

This invention squarely addresses the 48% of the mail flow generated by small entities and home users. It will also have application at individual and departmental levels in the larger firms. These sectors have been essentially ignored by the U.S.PS over the past ten years, with most of the automation technology interface being focused on the larger accounts. The U.S.PS has only recently recognized the implications of this omission, and is now embarking on a number of marketing efforts tailored to the small business and home office mailer.

Interfacing with Postal Accountability Systems

It is important to recognize that the proposed invention does not depart from current U.S.PS accountability systems—it actually enhances them. By accountability, we mean how the application of proper postage is confirmed by the U.S.PS.

Figure 1:
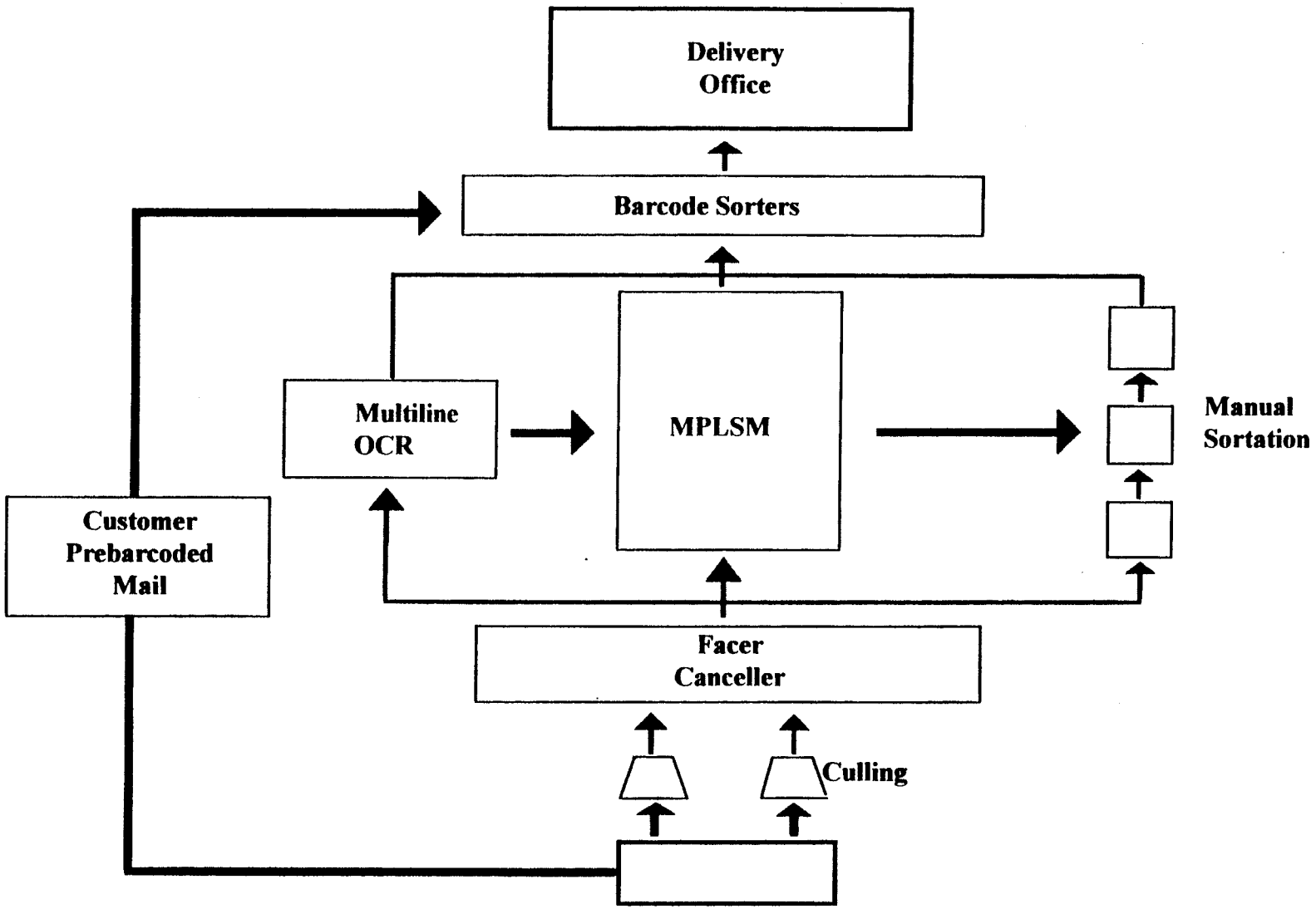
FIG. 1 illustrates the flow of incoming mail pieces in a General Mail Facility (GMF).

Stamps issued by the U.S.PS, as well as the red postage ink used in mechanical postage meters, contain a phosphorescent trace material which can be detected by the first mechanized equipment encountered by the mail piece. This machine is called the Facer/Canceller (c.f. FIG. 1). Its job is to flip envelopes so that the addressed/stamped face is uniformly facing forward and upright. The machine then applies a cancellation marking over those mail pieces carrying stamps. Metered pieces undergo no cancellation as the mark is integral to the envelope and not easily reused.

This machine also reads the FIM (Facing Identification Mark) to see if a stamp should even be expected and if a POSTNET bar code is on the mail piece. The four FIM's currently in use are:

| | |
|---|---|
| FIM A: | Bar coded - Look for stamp or meter |
| FIM B: | No Bar Code - Business Reply or Official Mail, no need to look for postage |
| FIM C: | Bar coded - Business Reply or Official Mail, no need to look for postage |
| FIM D: | No Bar Code - OCR Readable, look for stamp or meter |

If the mail piece has no FIM whatsoever, a stamp or postage meter mark will be expected.

The Facer/Canceller will route pieces which should have a stamp or meter mark, but show no detectable signs of one, to a separate holding bin for manual evaluation by U.S.PS personnel. However, the remaining and vast majority of the mail flow has no further check applied! In particular, the amount of postage applied to a mail piece is never checked by automated means. It is the carrier or manual mail sorter who has the primary responsibility for catching mis-posted mail pieces. (The U.S.PS Inspection Service also makes periodic spot checks and audits on mail streams.)

The limitations of the existing U.S.PS accountability system make the adaptation of the subject invention possible with little or no modification to existing postal equipment. PC printers do not operate with phosphorescent dyes, but such detection is irrelevant insofar as the proposed invention. Mail pieces produced with this invention would be treated like Business Replay or official "penalty" mail. The applied FIM code essentially instructs the Facer/Canceller to omit the phosphorescent check.

Additionally, one embodiment of this invention adds the POSTNET or UPC bar code equivalent to the postage amount, identifying meter number, and unique serial number. In this way, the same bar code scanners which read the ZIP+4 encoding for sortation purposes can also read and store the amount of postage and originating account number. Therefore, postage expenditure could be compared with postage purchases for any user of this technology. This would offer the U.S.PS a new and unprecedented level of accountability.

Provisions to Prevent Un-Authorized Duplication of the Postage Mark

An invention addressing this arena must provide appropriate safeguards against the duplication of postage marks on multiple envelopes or labels. With modern desktop PC's, scanners, and printers, it is possible to replicate a wide spectrum of images and designs. Those familiar with PC printers—particularly laser printers—are also aware that the printer can be instructed to make multiple copies of a single print image. This invention incorporates several means to prevent such abuse.

First, the metering software defaults to a single copy per envelope or label image for each print request. This is performed with a so-called "software reset command" which supersedes any command which may have been issued from the printer panel. The reset command is followed by an explicit command to produce one and only one image. Put another way, when in the metering mode, the software will not permit the multiple copy instruction to be sent.

If the user does ask for "n" multiple images of the same envelope or label, the software will produce "n" pieces, but it will not use the internal printer replication feature. Rather, the software will produce "n" distinct pieces by:

a. applying postage to each piece and deducting each amount from the running meter balance.
b. applying a unique serial number to each mail piece.

The unique serial number assigned by the software, combined with the U.S.PS meter ID number provided by the UQPS in the initial sign-up procedure, provides a unique ID for every mail piece produced with this invention. A subsequent automatic or manual audit would immediately uncover duplications.

The unique serial number also addresses another possible fraudulent activity which might be undertaken by a fairly sophisticated PC user. There are programs which permit one to capture a data stream which is destined for a printer port and place it in a file instead. If the image of a metered envelope or label were captured in this manner, it conceivably could be printed an unlimited number of times without using the main metering program.

Such an approach would. have several drawbacks. First, the serial number on each mail piece would be identical, clearly exposing the fraudulent activity. Second, the address of the mail piece would be the same for every copy, a fact which would severely limit the utility of such an effort. Third, when a comparison was made between actual metered mail passing through the U.S.PS automation equipment (by virtue of a bar code representation of the meter ID and postage amount) and the postage purchased via modem, an obvious discrepancy would arise.

This invention proposes means to obviate the capture of the printer data stream by software print-capture utilities. This is done by bypassing the very feature which the print-capture utilities employ. Essentially, on an Intel-based 808xx personal computer, there are three ways to convey information to the printer:

Use an MS-DOS Operating System service.
Use a BIOS (Basic Input/Output System) service.
Write directly to the printer hardware port.

The MS-DOS services actually call upon the BIOS services to perform the output. Print-capture utilities intercept the "interrupt vector" controlling the printer BIOS communications (interrupt vector #17 on the Intel 808xx processors) and route the print stream to a file instead.

One embodiment of this invention contemplates writing directly to the printer hardware port. In this way, no program can intercept the data stream. Sending multiple copies of the same postage mark to the printer thus becomes impossible. In the "C" language, communicating directly to the printer port is accomplished with the outportbo and inportbo functions. Sample C code which accomplishes such an operation is shown below:

```
#define P_DATA      0×3BC /* Port LPT1: */
#define P_STATUS    (P_DATA+1)
#define P_CNTRL     (P_DATA+2)
#define TIMOUT      1000
int main(void)
```

-continued

```
{
    char *string = "Print non-capturable test string?/n";
    char c;
    int status;
    while( (c=*string++) != ' 0')
    {
        status = print(c);
        if (status != 0×90)
        {
            printf("printer problem");
            break;
        }
    }
    return 0;
}
int print(int symbol)
{
    unsigned int status;
    unsigned int time_out = TIMOUT;
    outportb(P_DATA,symbol);
    while(time_out!=0)
    {
        if( inportb(P_STATUS) & 0×80 ) break;
        time_out--;
    }
    status = (inportb(P_STATUS) & 0×f8)    0×48;
    if(time_out==0) status |=1;
    if(status!= 0×90) return status;
    outportb(P_CNTRL, 0×0d);
    outportb(P_CNTRL, 0×0c);
    return status;
}
```

Comparable functionality may be achieved with assembly or other languages which permit low level machine control.

It is important also to put potential fraudulent activity in the proper perspective. The U.S.PS, and its Inspection Service in particular, has dealt effectively with Postal fraud since the U.S.PS's inception over 200 years ago. There are—and there will continue to be—stamp counterfeiters, people who steam off and resell stamps, mail permit abusers, and those who tamper with meters. These elements will always be part of any society. The invention described here will be similarly abused by a minority. However, the U.S.PS enforcement program will remain as an effective deterrent, as will the substantial Federal penalties for mail fraud. In the inventor's view, the necessary level of checks and balances are in place, and the benefits of this invention vis-a-vis postal automation and customer convenience far outweigh the fraud potential or actual losses to illegal activity.

A final point speaks to the level of expertise required to abuse the invention described here. Abuse would require the participation of a very skilled computer programmer. There are many skilled programmers in our society, but only a small percentage would engage in fraudulent behavior. And, their skill level would have to be at least as sophisticated—if not more so—as those who have the skills to tamper with mechanical postage meters.

Altemate Embodiments of the Postage Mark Electronic Postage Mark Emblems

The sample postage mark presented in FIGS. 5 and 6 is a very simple design which serves to express the fundamental information required by the U.S.PS —city/state of origin, date of issue, amount of postage, and meter number. This invention additionally provides for a unique serial number for each mail piece, and bar code representations of the postage amount and numerical identifiers.

Referring to FIG. 5, item 1 is a destination address and item 2 is a POSTNET bar code representation of the ZIP+4. The facing identification mark, item 3, is shown as a FIM C configuration which indicates that stamp cancellation is not required. It should be noted that a new FIM configuration could also be employed to further distinguish mail posted using this invention.

Item 4 is the postage mark as applied by laser printer. Item **4.*a* is the date of posting, applied by the computer program at the time of printing. Item 4.*b* is the City/-State of sender, entered via a supervisory or setup function in the computer program. Item 4.*c* is a box prefaced with the phrase "U.S.Postage". Item 4.*d*** is the computed postage, incorporating any valid U.S.PS discounts based on the POSTNET and ZIP+4 status.

Item **4.*e* is a unique meter identification number issued by the U.S.PS via a program initiation session managed by the software. This one-time setup session is accomplished via PC and modem. Item 4.*f*** is a optional bar code representation of the postage meter ID. This code could be read by wide-area bar code scanning equipment currently being installed nationwide to read the POSTNET bar codes, and used for future audit operations.

FIG. 6 is an analogous posted label created from a 4"×6" peel off label which is compatible with most laser printers.

An alternate embodiment of this invention continues to provide the foregoing text-based and bar coded information, but contemplates the additional use of one or more complex graphical emblems, similar in some ways to the artistic and thematic content expressed in the regular stream of U.S.PS stamp "new issues," or as seen in the existing Pitney Bowes metering stamp (a curvilinear line-art rendering of an eagle). While effectively limited to a black and white format, these images could be telecommunicated to the postal customer's PC when additional postage is purchased. The images would be stored in encrypted "hidden" files on the computer (a subsequent section will discuss this in more detail as it pertains to the postage balance files). The images could be cast in industry-standard graphic formats such as TIFF or PCX, or a unique file format recognized and processed only by the metering and mail management software contemplated as part of this invention.

Receiving these new postage meter images could be made optional, based on user preferences, or mandatory. The mandatory implementation could be a useful means to frustrate and control counterfeiting and/or unauthorized production of the postage mark. By way of example, the U.S.PS could choose to change the postage mark on a three month cycle. Users would add this new mark to their system when they next purchased postage. Duplicators could, of course, quickly obtain a copy of the new image and begin the process of duplication and illegal distribution. However, their distribution network would pale in the light of the U.S.PS postage purchasing telecommunications 800 number network. By the time the duplicators had achieved any substantial distribution of the unauthorized image, the U.S.PS would have issued a new version which would be mandated for acceptance in the national mail stream by some published cut-off date.

It should be mentioned that laser printers, inkjet printers, and the new bubble jet printers have resolutions of 300 dots per inch or greater. This means that postage marks could be designed with very high resolution, and printed with equally high resolution on the invention described here. Subsequent unauthorized copies would not be able to maintain this level of resolution and would therefore be detectable.

Safeguarding the Personal Postage Meter Balance

Perhaps the foremost security issue relevant to this invention revolves around the meter balance. Mechanical postage meters display a "remaining balance" figure indicative of the dollar amount of postage still available to the user. Funds are deducted from this running balance each time the meter applies postage. Funds are periodically added by a Postal clerk using special tools when the meter is taken to the post office. The meter balance is ostensibly protected from subsequent tampering by the customer by means of a wire and soft lead seal applied by the Postal clerk.

The computer-based personal postage meter contemplated in this application must provide comparable or improved security. The issue of meter balance security must be considered from two perspectives:

a. Protection against loss of U.S.PS revenues due to customer fraud.
b. Protection against a dollar loss to the customer due to equipment breakdown.

Both protection issues are tied to the means in which the running balance is stored. Basically, there are only two classes of storage media which are "non-volatile", that is, where the information will not be lost when the computer is turned off. The two media are:

Disk media ("hard" or floppy media).

Hardware memory chip with battery backup.

Protecting the Customer's Meter Balance Investment

The issue of protecting the customer's investment in postage may be addressed by examining the Mean Time Between Failure (MTBF) statistics for computer components, and by further recognizing that the maximum amount of postage permitted in the Personal Postage Meter could be kept low (say $75). The low ceiling on meter balance is quite practical as additional postage can be purchased in a minute or so, 24 hours a day/7 days a week.

The MTBF values are available on a component-by-component basis, but one can assume that the average life of a disk or memory chip is at least three years. Further, when hardware problems do occur, they often provide ample warning to allow recovery processes to be applied. For purposes of discussion, if the risk of catastrophic and unrecoverable meter data loss in a given year period is 5% (a high value, in the inventor's view), the expected value of loss would be ($75/*0.05) =$1.87. Here we have assumed that the meter balance is half way between the maximum of $75 and $80 at the moment of loss. The applicant submits that most people would be willing to "pay" $1.87/year in return for never having to stand in line in the Post Office again.

The expected value of loss should also be compared to the cost of renting the smallest mechanical postage meter from Pitney Bowes. This cost is on the order of $200/year and, because these machines may only be rented, the cost recurs year after year. Essentially, the metering concept advanced in this application obviates the annual rental costs and allows the small mailer to use his/her existing desktop computer investment to provide an even more advanced metering capability.

Preventing Fraudulent Manipulation of the Meter Balance: Controlling File Access This invention envisions several embodiments for the storage of the meter running balance. Once again, the only media available for storage are disk or hardware (memory chip), and this invention contemplates utilizing one or both of these media.

Disk-based storage is the simplest and involves no cost. However, the potential for tampering is significantly higher than that offered by hardware security solutions. Disk-based data files can be protected to some extent by either employing data encryption algorithms to the information stored and/or by assigning access limitations to the data files themselves.

In the Intel/MS-DOS environs, file access may be restricted by setting the file attributes in the File Allocation Table (FAT). Configurations may be established whereby the file may be accessed and manipulated by the Personal Postage Meter Application, but not copied or otherwise accessed.

Another level of file security is the MS-DOS "hidden file" attribute. Hidden files are not revealed by normal "directory" list commands. Nor can they be copied using standard copy commands.

Limited access and "hidden" files can be managed on both floppy and hard disk media.

Finally, the concept of "files" may be completely eliminated if the application writes directly to the disk track/sector without benefit of the usual MS-DOS or similar operating system services. Rather, BIOS services are employed to write directly to the physical media. By way of example, in the "C" language, this may be accomplished with code similar to that in the following listing. The code presented writes and then reads a test message string to track=1 and sector=1 of diskette drive A: specified in the ANSI-C biosdisk( ) function:

```
int main(void)
{
    int result;
    char buffer[512];
    result = biosdisk(0×16,0,0,1,1,1,buffer);
    if(result)
    {
        printf("Drive no Ready! n");
        exit(0);
    }
    else printf("Drive on Line n");
    strcpy(buffer,"This is a secret number");
    result = biosdisk(0×3,0,0,1,1,1,buffer); // write to disk
    if(result) printf("Write error on disk n");
    result = biosdisk(0×2,0,0,1,1,1,buffer); // read from disk
    printf("%s", buffer);
    exit(0);
}
```

This technique completely disregards any other file information which might be stored on the disk. Because of this, the approach would be limited to a single-purpose diskette-media which would be inserted into the computer when postage operations were under way. The diskette would be labeled as a "Postage Meter Diskefte" and would be required whenever postage was purchased or applied. A directory listing of a diskette manipulated in this way would reveal no file structure whatsoever.

The file access controls discussed here would prevent the vast majority of PC users from tampering with the meter balance file. The foregoing substantial technical hurdles, the severe penalties for postal fraud, and the provisions for modem-based audit by U.S.PS Inspection Service personnel (another facet of this invention described in a subsequent section), would serve as a major impediment to fraudulent meter manipulation. However, even more aggressive security measures are possible using hardware approaches.

Preventing Fraudulent Manipulation of the Meter Balance: Hardware Approaches A more costly—but significantly more secure—means of storing meter balance data is in a non-volatile memory chip which can be addressed directly by the PPM application. In this situation, there is no possible way to access the stored data unless one has access to the proprietary design codes embedded in the hardware component.

One interesting concept advanced in this application is the integration of existing modem boards with one or more additional memory chips and lithium battery to arrive at a "PPM modem".

FIG. 12 illustrates a typical internal modem card used in millions of personal computers. The card already provides access to the CPU bus and provides a means of direct communications through an 8250 UART (Universal Asychronous Receiver/Transmitter) chip.

By adding one additional memory chip 12*a* (such as an MK48Z02 RAM), a long-life lithium battery, and a few circuit interconnects to a mass-produced PC modem board, the resulting configuration would provide complete modem functionality for all forms of PC communications plus the specific meter balance Storage functionality. The integrated approach is particularly appropriate inasmuch as the modem is a required element in the overall PPM design—it is used to purchase postage and access ZIP+4 codes.

Note that external modem configurations can be employed in an identical fashion. External modems are comprised of the same basic circuits, but require a case and distinct power supply and are therefore more costly to produce.

Of course, a electronic circuit board comprised of a memory chip and battery could also be designed for the sole purpose of maintaining the meter balance. However, the combined approach (modem plus meter balance memory) is vastly preferable as only one PC bus slot is consumed and the cost for production and distribution of "commodity" modem boards is quite low.

Refunds for Imperfect Prints

It is common to encounter print-time errors with personal computer printers which result in printed specimens which cannot be used/mailed. Postal customers could receive credit for such pieces in the same manner that credit is made available for postage meter errors. The customer need only retain the defective pieces and periodically submit them to the U.S.PS for credit.

It is noteworthy that the credit could be applied at the next postage purchase session via telecommunications.

Implementation Hurdles

The validity of a patent application is frequently and correctly tied to its practicality. The applicant is fully aware that there are very substantial institutional barriers to overcome before this invention emerges as an operational reality. We would like to devote this short section to a discussion of how these barriers might be overcome. (We realize that this section would most likely be omitted from the final patent.)

The applicant has been an automation consultant to the U.S.PS and other government agencies for over ten years. The previously-mentioned Envelope Manager software and companion Dial-A-ZIP technology are being used nationwide by the U.S.PS for its daily business mailings. The software and related technology is extremely well known from the Postmaster General level, through key Assistant Postmaster General levels in the various operational groups, down to customer service representatives at the community level.

The invention described here represents a significant departure from long-standing and time-honored Postal methods for the purchase of postage and individual metering. Extremely cautious initial reactions are to be expected from U.S.PS Finance, Inspection Service, Address Information, and Rates and Classifications Departments among others. Additionally, the existing postage meter vendors will likely object to this technology on competitive grounds.

However, given this invention's tremendous benefits in terms of U.S.PS cost control and customer convenience, combined with the continuing proliferation of PC hardware in homes and businesses, the applicant is optimistic regarding the eventual acceptance of this invention.

THE PROCEDURE TO PRINT A POSTED MAIL PIECE

To further understand how this invention functions, it may be helpful to review the actions of a user who wishes to create a posted envelope or label.

1. The user enters the address in the PC data base environment provided by the PC envelope/label generating software (such as Envelope Manager). Alternately, the user selects an existing entry in the address data base. See FIG. 7, which illustrates a typical address entry/modify screen with the Dial-A-ZIP ZIP+4 look up feature.

2. If a new address is being entered, a CASS-certified ZIP+4 is obtained by invoking a Dial-A-ZIP query. In the Envelope Manager software, this is accomplished by pressing the ALT-F2 key combination. In approximately 15 seconds, the validated ZIP+4 is returned and stored with the address record. (FIG. 7)

If a previously-stored address is being printed, the date of the last ZIP+4 verification is compared to today's date to ascertain if the ZIP+4 is older than 6 months. If so, the user will be warned of this fact and invited to revalidate the address via Dial-A-ZIP, or continue with the print and dispense with any postal automation discounts/ automation markings.

3. The user will request that an envelope, label or flyer be printed. In Envelope Manager, this is accomplished by positioning a cursor at the address of interest and pressing ENTER.

4. If the postage application option has been selected in the formatting or supervisory sections of the program, the user will then be prompted for (c.f., FIGS. 8,9):

---

Parcel weight
or

-continued

Number of 8½" × 11" pages.

FIG. 8 shows a typical print request screen (enhanced from the production version of Envelope Manager accompanying this application) which shows a print-time "Apply Postage" option. FIG. 9 illustrates a typical detail screen which would appear when the Postage Option was selected. Here the user can input the weight of the parcel to be mailed or have the PC infer the weight based on the number of standard pages to be enclosed. This screen also shows the remaining postage available to the system.

If an optional weighing device (e.g., load cell) is connected to the personal computer as shown in FIG. 1 1, the program will prompt for the placement of the mail piece (or components of the mail piece) on the weighing surface. The weight will then be ascertained by the computer and reported on the computer screen. FIG. 11 illustrates a typical personal computer (item 11.*a*), printer (item 11.*b*), a modem (item 11.*c*), a standard phone line (item 11.*d*), and an optional weighing device (item 11.*e*). FIG. 12 illustrates a typical internal modem board for a personal computer.

5. The program will now compute the required postage based on weight, destination and zone (based on ZIP Code), the ZIP Code status (a validated ZIP+4, will qualify for a discount), and then print the envelope, label or flyer, complete with postage mark.

6. The remaining postage register file (an encrypted file on the PC or memory chip) is reduced by the amount of the last transaction and the just-completed transaction will be posted to a log. (The log may be printed out at any time for a history of postage expenditures by addressee, date of issue, etc.)

THE PROCEDURE TO REPLENISH POSTAGE

The user selects a Setup Option which submits the electronic request for additional purchase. FIG. 10 illustrates a typical program screen to purchase additional postage via telecommunications. As shown in FIG. 10, the user inputs his/her credit card number, the card expiration date, amount of postage requested, and the phone number of the nearest U.S.PS facility prepared to process this electronic purchase. When all fields are complete, a single key will dial this number and automatically submit the request.

The U.S.PS receiving facility performs a real-time credit verification with MasterCard or VISA and, within seconds, returns a signal which increases the postage on the PC by the specified amount. The postage value is stored in an encrypted, "hidden" DOS file which precludes tampering, or in a memory chip.

An alternate embodiment of the invention amends the foregoing process to include a "call-back" protocol. Call-back protocols are frequently used in high-security computer installations. The user intending to connect to the central computer resource first calls in and enters his or her [D and password. The central computer then disconnects the phone connection and, employing a previously-stored phone number for this user, dials the number of the remote machine to re-establish the connection.

This added level of security would further ensure that postage purchases reached the correct party and that the appropriate credit card account was charged.

INITIAL ENROLLMENT PROCEDURE

Replenishment of postage will be a routine procedure accomplished in a manner previously discussed. The U.S.PS will likely desire an initial "sign-up" which will register new users for this service. This invention contemplates that this process will also be accomplished via modem through the Envelope Manager (or similar) program.

The initial sign-up screen will ask the user to submit:

User's name and address
Credit card number
Estimated monthly purchases
User's modem number (for audit purposes)
User's voice number (for audit purposes)
Any other statistics deemed useful by the U.S.PS The user will receive an assigned meter identification number immediately or via a subsequent telecommunications session which will be applied to all mail pieces produced by this user.

ELECTRONIC FIELD AUDITS BY THE U.S.PS INSPECTION SERVICE

Periodic audits by the U.S.PS Inspection Service will be accomplished using the same telecommunications hardware employed to purchase postage. However, the Inspection Service will call into the remote PC.

The provision for remote electronic audit could be a precondition for utilizing the postage purchasing technology described in this invention. The audit would begin with an Inspector calling the user on his/her voice line and requesting an audit. (This call could actually be automated, with a computer, not a person, issuing verbal instructions to the user).

The user would be instructed to load the Envelope Manager software select a supervisory option for the audit process. This would be the extent of the user's actions. The audit option would place the person computer modem in "automatic answer mode." At this point, the Inspector (or main U.S.PS computer!) would dial the modem number of the registered meter user and establish a connection. The Inspector (or U.S.PS computer) could then request one or more audit reports to be sent from the remote computer to the Inspector's computer which might include:

A history of postage purchases
A running total of postage affixed.
A detailed log of postage applied by mail piece.

This information could immediately be compared with data maintained at the point-of-purchase computer, information gathered via the bar code scanning equipment, benchmark data based on a "typical user," or historical data for this particular user. Using this information, the Inspector (or computer) could choose to accept the audit results, or call for a more detailed site audit if suspicious circumstances were detected.

The audit process could also reset certain running totals, change encryption schemes, or even "lock" the postage metering function until a more complete audit was completed.

Electronic Update for Postage Rates

Postage rates, zones and regulations go through periodic changes. The most recent set of rates (February, 1991) are among the most complex.

Using the same hardware and software employed for electronic postage purchase and audits, new rate tables could be loaded to the individual user's computers via phone line and modem. In fact, the rate table in each user's machine could be checked during each electronic purchase event and loaded to the remote machine as required. In this way, users of the this invention would have easy and consistent access to the latest rate structures.

Applying the Correct Date

Most mechanical meters rely upon the operator to set the current date. The U.S.PS encourages accurate postmark dates as they are often the basis for determining late payment criteria, but there is little the organization can do to prevent misuse. There are many reports of meter users setting the date back when paying taxes or other time-critical payments.

The invention described here employs the computer's internal date as the postage. Most PC's sold in the past five years include an internal clock-calendar for this purpose. This will avoid inadvertent date misrepresentation due to the operator simply "forgetting" to set the new date.

The experienced PC user knows that it is possible to reset the system date in a number of ways. However, this invention can cross check against the running log of postage applications to see if the "current date" is actually prior to some of the dates in the log. If this is so, it will prevent the user from continuing with an invalid date.

The invention therefore greatly improves the reliability of the date applied on the postmark and thus meets a key objective of the U.S.PS.

Log of Postage Expenditures

The metering invention described here provides a convenient method to record and report upon postage expenditures with minimal user input. Each time a mail piece is posted, the date, destination address, amount of postage, discount amount, and other information are automatically recorded in a separate data file.

This file may then be printed and summarized to obtain a complete profile of all mailing costs. This file can also be used in the UQPS audit process described elsewhere. The following is a sample log of postage expenditures recorded in that file:

| Date | Destination | Address | Postage Used | Postage Remaining |
|---|---|---|---|---|
| 060191 | Mr. Puliman | 1442 Rose Lane Anytown, CA 94501-5501 | $0.52 | $60.00 |
| 060391 | Mrs. Gail Sachs | 17 Moira Drive Anytown, CA 93301-1022 | $0.29 | $59.71 |
| 060391 | Mr. Carbonara | 85 Knotson Blvd. Anytown, CA 94003-2007 | $0.29 | $59.42 |
| 061491 | Ms. Simpson | 18 Danbury Ave. Anytown, CA 92121-3745 | $0.75 | $58.67 |
| 071091 | Ms. Kinsey | 2331 Pacific Ave. Anytown, CA 94115-2442 | $0.75 | $57.92 |
| 071091 | Mr. John Davis | 1582 Seacliff Drive Anytown, CA 92123-2441 | $0.29 | $57.63 |
| 071291 | Mr. Greg Fong | 1821 16th Ave., Anytown, CA 91311-4239 | $1.21 | $56.42 |
| 071891 | Mrs. Joyce Jones | 445 Green St, Anytown, CA 94117-9445 | $9.95 | $46.47 |

-continued

| Date | Destination | Address | Postage Used | Postage Remaining |
|---|---|---|---|---|
| 072591 | Mrs. K. Pierce | 17 Jones St., Apt #2, Anytown, CA 93212-9998 | $2.90 | $43.57 |
| 080591 | Computers Inc. | 1821 North Lake Blvd, Anytown, CA 92231-0909 | $0.75 | $42.82 |
| 080591 | Blue Bear Ltd. | 178 Madison St., Ste 1010, Anytown CA 92114-2221 | $2.90 | $39.92 |

Although only a single embodiment of the invention have been described, it will be apparent to a person skilled in the art that various modifications to the details shown and described may be made without departing from the scope of the invention.

What is claimed is:

1. A computer system for purchasing postage and applying postage to mail pieces, comprising:

a central processing unit;

a printer coupled to said central processing unit;

a modem connecting said central processing unit to a telephone line; said modem including a secure non-volatile memory; and a postage control program executed by said central processing unit for purchasing postage via said modem from a remotely located postal authority computer, for storing purchased postage information in said secure non-volatile memory, for controlling said printer to print postage on mail pieces, and for storing postage usage information in said secure non-volatile memory.

2. The computer system of claim 1, said postal usage information stored in said non-volatile memory including information indicating portage applied to each of said mail pieces;

said postage control program further including call answering means for enabling said remotely located postal authority computer to retireve said postal usage information stored in said non-volatile memory.

3. The computer system of claim 1, said postage control program including means for printing a unique serial number, including a unique assigned meter identifier, on each mail piece and means for directly controlling said printer to print postage and said unique serial number on each mail piece so as to prevent said printer from printing said postage and serial number on multiple mail pieces.

4. A method of purchasing postage and applying postage to mail pieces using a computer that includes a printer and a modem that connects the computer to a telephone line;; the method comprising the steps of:

providing said modem with a secure non-volatile memory;

purchasing postage via said modem from a remotely located postal authority computer, and storing corresponding purchased postage information in said secure non-volatile memory;

controlling said printer to print postage on mail pieces; and storing in said secure non-volatile memory postage usage information corresponding to said postage printed on mail pieces.

5. The method of claim 4, said postal usage information stored in said non-volatile memory including inforamtion indicating postage applied to each of said mail pieces;

said method further including enabling said remotely located postal authority computer to retrieve said postal usage information stored in said non-volatile memory.

6. The method of claim 4, said controlling step including controlling said printer to print a unique serial number, including a unique assigned meter identifier, on each mail piece and directly controlling said printer to print said postage and said unique serial number on each mail piece so as to prevent said printer from printing said postage and serial number on multiple mail pieces.

* * * * *